US005155976A

United States Patent [19]

Okabe et al.

[11] Patent Number: 5,155,976

[45] Date of Patent: Oct. 20, 1992

[54] CONVEYOR SYSTEM OF DUST CONTAINERS USED IN TALL BUILDINGS

[75] Inventors: Younosuke Okabe; Takao Sekigawa; Tadashi Suzuki, all of Utsunomiya, Japan

[73] Assignee: Fuji Jukogyo Kabushiki Kaisha, Tokyo, Japan

[21] Appl. No.: 777,624

[22] Filed: Oct. 16, 1991

[30] Foreign Application Priority Data

Mar. 29, 1991 [JP] Japan ..... 3-91349

[51] Int. Cl.[5] ..... B65B 1/24

[52] U.S. Cl. ..... 53/527; 53/576; 232/44; 406/14

[58] Field of Search ..... 53/527, 528, 523, 436, 53/576, 577; 193/34, 32; 232/44, 53; 406/14; 100/229 A

[56] References Cited

U.S. PATENT DOCUMENTS 3,721,060 3/1973 Quinto ..... 53/527
3,765,147 10/1973 Ippolito et al. ..... 53/527 X
3,861,117 1/1975 De Filippi ..... 53/527
4,117,777 10/1978 Schipman ..... 232/44 X
4,457,125 7/1984 Fishburne ..... 53/527
5,031,829 7/1991 Shantzis ..... 232/44 X

*Primary Examiner*—James F. Coan
*Attorney, Agent, or Firm*—Beveridge, DeGrandi & Weilacher

[57] ABSTRACT

In a conveyor system of dust containers for using in a building, particularly an apartment house, dust discarded from respective houses is contained in a cylindrical polysheet, which is clipped at separated points to form dust capsules having a smaller diameter than the inner diameter of a vertical chute so that the capsules in the chute are subjected to air resistance. A pressure detector is provided near the bottom of the chute. In response to the output of the pressure detector the quantity of air escaping to the outside from the upper end of the chute is controlled so that the falling speed of the capsule is adjusted to a safe value.

8 Claims, 8 Drawing Sheets

CONVEYOR SYSTEM OF DUST CONTAINERS USED IN TALL BUILDINGS

BACKGROUND OF THE INVENTION

The present invention relates to a conveyor system of dust containers used in buildings wherein the dust container takes the form of a capsule packed with dust and made of a pliable synthetic resin sheet.

Dust discarded from homes in a tall apartment house or an office building has been collected by packing the dust in vinyl bags, and the bags are dropped down through a vertical dust chute having a diameter of about 500 mm.

However, since the height of the apartment house becomes higher year by year, the faster falling speed of the dust bags are, such that the dust bags are broken by colliding against the wall of the dust chute during falling or against the ground surface. Once broken, inside walls of the vertical dust chute would be contaminated, and then arise hygienic problems, such as bad smell, growth of noxious insects and etc.

To prevent these problems, there have been proposed various measures. According to one solution, the dust is sealed in a predetermined volume, and the gap between the outer diameter of the capsule and the inner diameter of the vertical dust chute is made small. Furthermore the weight of the capsule and the pressure in the dust chute are controlled to balance the gravity and the air pressure resistance against the falling capsule. According to another solution, a rising air stream is created in the vertical dust chute and the flow speed of the rising air speed is controlled to correspond to the falling speed of the capsule. The air speed is set at a point above the rising air stream so as to make constant the falling speed of the capsule whereby the capsule can reach the ground without any shock. According to the other solution, a deceleration pipe having a smaller diameter than the inner diameter of the dust chute is connected just above the lower end of the dust chute. (Reference is made to Japanese Laid Open Patent Specification Nos. 286/1985, 25280/1985 and 160904/1985)

According to the above prior arts, it is necessary to use a dust capsule having a definite shape. A large plastic vessel has troubles for recovery and washing. In a throwable vessel (capsule) such as a small paper bag which can be readily moved or carried by housewives, there is a trouble of transferring the dust from one to other capsule. 700–800 capsules are used in one house a year, so that the cost of the capsules becomes a huge amount. For this reason, using such capsules is limited. Where the diameter of the dust chute increases, the weight of the dust capsule also increases so that it is necessary to increase the pressure of the rising air stream necessary to prevent rapid dropping of the capsule. To this end, it is necessary to minimize as far as possible the gap between the inner surface of the chute and the outer surface of the capsule. For the purpose of making the storage space small, solid capsules are generally take the form of a frustoconical shape for easily piling up. As a consequence, it is impossible to gradually decrease the gap area, at a constant rate, in the longitudinal direction of the capsule. For causing the capsule to drop at a definite speed by balancing with each other the air resistance and the capsule weight it is necessary to make the gap small between the upper portion of the capsule where its diameter is large and the inner surface of the dust chute. However, it is difficult to predetermine correct dimension of the clearance.

Where the gap between the capsule and the vertical chute is decreased, the capsule often contacts against the inner wall of the dust chute and is broken.

In the solution described above, wherein a speed decreasing pipe having a small diameter is installed near the lower end of the dust chute for softly landing the capsule, the falling speed would increase at a portion of the chute of a large diameter, there is a tendency that the capsule would be damaged when it enters into the speed decreasing pipe causing splashing of the dust and spoiling the inside of the dust chute.

In the other solution wherein air is blown up by a blower installed at the lower end of the dust chute for decreasing the falling speed of the capsule, not only the cost of installation increases but also maintenance of the equipment is trouble.

SUMMARY OF THE INVENTION

Accordingly, it is an object of this invention to provide an improved conveyor system of dust containers accurately decreasing the falling speed of a capsule falling down in the vertical chute in accordance with the weight of the falling capsule, the conveyor system having a relatively simple construction and can be constructed at a relatively low cost.

Another object of this invention is to provide the conveyor system of dust containers accurately decreasing the falling speed of a capsule falling down in a vertical chute wherein the dust is a rectangular block, for example, a stack of news papers or magazines.

According to this invention, there is provided a conveyor system of dust containers used in a building comprising a vertical chute for falling a dust container packed with dust discarded from respective floors of the building, the container being formed as a soft cylindrical body having a smaller outer diameter than an inner diameter of the vertical chute; means for laterally moving a portion of the chute; means for clipping upper and lower ends of the soft cylindrical body so as to form a capsule packed with dust; a bottom plate located at a lower end of the vertical chute; means for laterally moving the bottom plate for closing the lower end of the chute; adjustable air discharging means located above the bottom plate for discharging air in the vertical chute; and a pressure detector for detecting air pressure in the vertical chute for adjusting the air discharge means so as to control the falling speed of the dust container.

According to a modified embodiment of the present invention, there is provided a conveyor system of dust containers used in a building comprising a vertical dust chute through which dust containers packed with dust discarded from respective floors of the building fall down; the dust chute having a removable section, upper and lower ends of the removable section and end portions of the dust chute between which the removable section is to be inserted to form a continuous chute are inclined, a stationary dust receiver containing a cylindrical polysheet filled with dust; clipping means for clipping opposite ends of the polysheet containing the dust for forming a capsule of dust; an auxiliary cylinder located below the clipping means for receiving the capsule of dust from the clipping means; means for mechanically interconnecting the auxiliary cylinder and the removable portion; and first means for simultaneously shifting the auxiliary cylinder, and the removable section for aligning the auxiliary cylinder with the dust chute and for separating the removable section from the dust chute.

BRIEF DESCRIPTION OF THE DRAWINGS

In the accompanying drawings:

FIGS. 5 through 8 show automatic clipping device in which FIG. 5 is a perspective view showing the clipping device in an inoperative state, FIG. 6 is a perspective view showing the clipping device in an operative state, FIG. 7 is a plan view of the clipping device and FIG. 8 is a side view of the clipping device;

DESCRIPTION OF THE PREFERRED EMBODIMENTS

Figure 1:
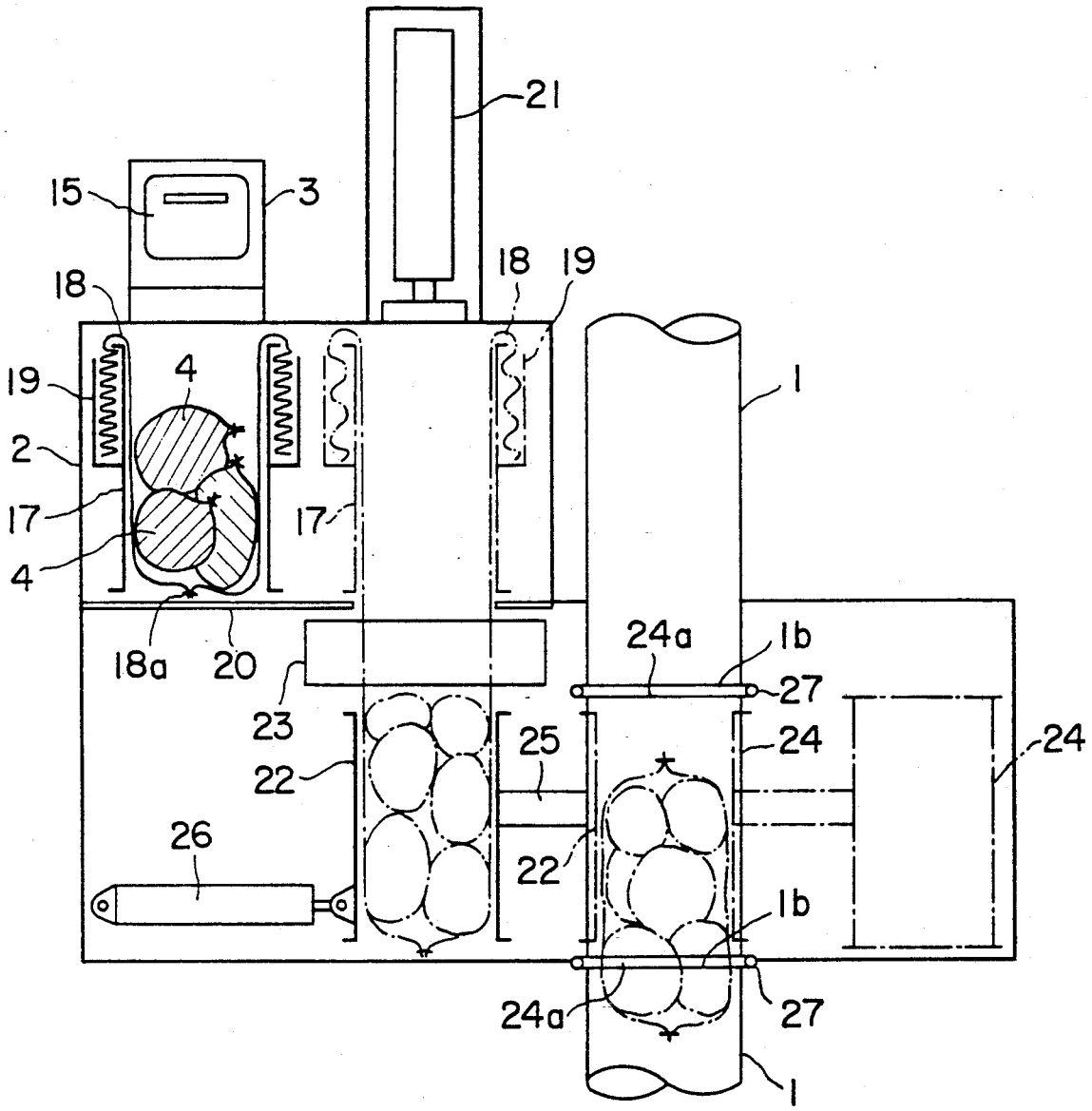
FIG. 1 is a front view, with essential elements enlarged, showing a conveyor system of this invention.
Figure 2:
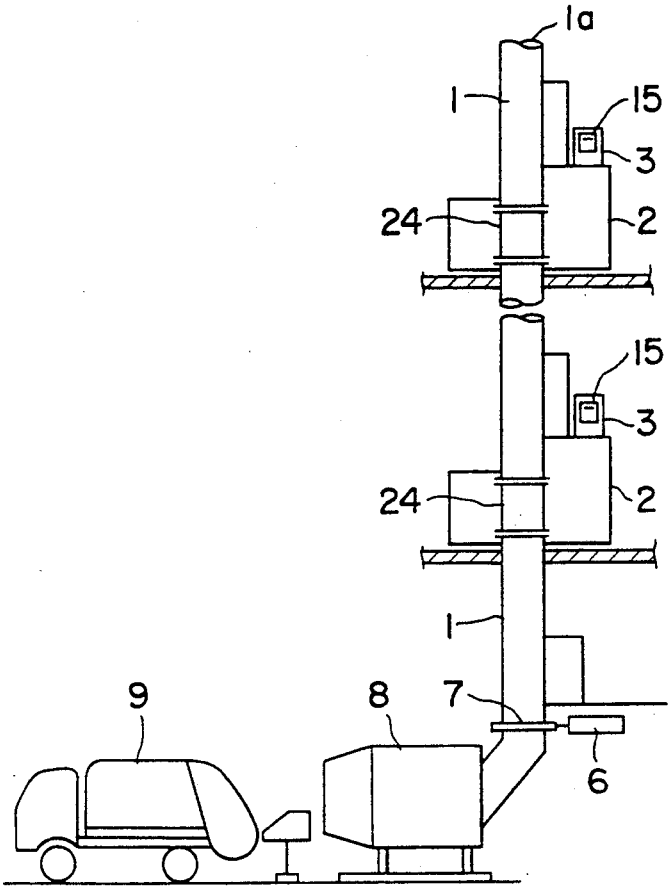
FIG. 2 is a side view showing the entire conveyer system.

FIGS. 1 through 12 show the first embodiment of this invention. As shown in FIG. 2, a vertical conveyance pipe, that is a dust chute 1 provided vertically extending through respective floors of a tall building, for example an apartment house. In each floor is installed a body 2 having a capsule inlet port 3 in parallel with the dust chute 1. The purpose of this chute is to permit falling down of capsules 5 (see FIG. 1) packed with dust 4 and thrown into the chute through inlet ports 3. At the lower end of the chute is provided a horizontal bottom plate 7 which is operated by a piston-cylinder assembly 6 to open or close the lower end of the chute.

The capsules dropped down through the chute 1 are collected in a collection tank 8. When this tank 8 is completely filled with capsules, they are conveyed by a dust collecting car 9.

Figure 3:
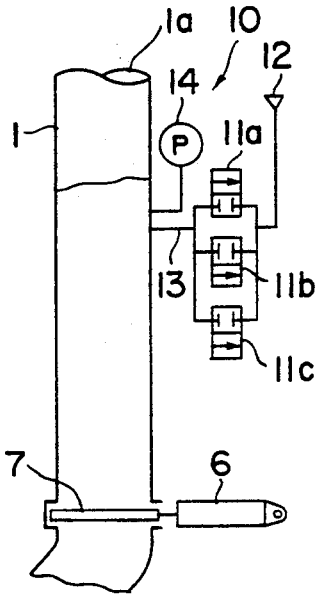
FIG. 3 is a partial view showing the lower portion of the vertical dust chute.

As shown in FIG. 3, an air exhausting device 10 is provided at a portion above the bottom plate 7. More particularly, an air exhausting port 1*a* provided for the chute 1 and the air exhausting port 1*a* is connected to an air exhausting pipe 13 in communication with three valves 11*a*, 11*b* and 11*c* which are connected to surrounding atmosphere through a vent opening 12. These valves 11*a*, 11*b* and 11*c* are opened and closed by a signal from a pressure detector 14, for detecting the air pressure in the vertical chute 1.

With this construction, the weight of the capsule in the chute 1 is detected by detecting the air pressure in the chute with the pressure detector 14 where the falling speed of the capsule is higher or lower than a predetermined value, valves 11*a*, 11*b* and 11*c* are suitably closed or opened to control the quantity of exhausted air so as to maintain the falling speed of the capsule at a predetermined value.

Thus, while the chute is being hermetically sealed the capsules are dropped, the air pressure Pd in the chute when the falling speed of the capsule becomes a constant value, the air pressure Pd in the chute is expressed by the following equation:

$$Pd = \frac{W}{Ac}$$

where W represents the weight of a capsule, and Ac represents the cross-sectional area of the capsule.

The compressed air beneath the capsule 5 rises upwardly by passing a gap through the capsule 5 and the vertical chute 1. At this time, the falling speed of the capsule 5 is subjected to air resistance. This air resistance is a sum of a pressure loss due to a rapid decrease in the sectional area created when the air enters into a narrow gap, a flow resistance created when the air flows at a high speed through a narrow gap (at a speed, several times larger than the falling speed of the capsule 5), and a rapidly expanding pressure loss which occurs when the air enters into the large space in the chute from the narrow gap between the capsule and the inner wall of the chute, the rapidly expanding pressure loss having the greatest influence upon Pd.

This air resistance (opposing force) R is expressed by the following equation:

$$R = Cd\frac{\gamma}{2g}\left(\frac{Ac}{Ad - Ac}\cdot v\right)^2$$

where:

γ—specific weight of air v—falling speed of a capsule

Ad—cross-sectional area of dust chute

Cd—coefficient of opposing force

The value of Cd is definite dependent upon the configuration of the dust capsule.

Since the air resistance is equal to the air pressure described above, the following equation holds:

$$v = \sqrt{\frac{2g}{Cd}\cdot\frac{W}{\gamma}}\cdot\frac{Ad - Ac}{Ac^{\frac{3}{2}}}$$

This equation shows that the falling speed of the dust capsule is proportional to the square root of weight W of a dust capsule. Where the dust chute diameter and the capsule diameter are known, the following equation holds.

$$\frac{Ad - Ac}{Ac^{\frac{3}{2}}} = \text{constant}$$

v is determined directly by W.

Since above equation holds when the vertical dust chute is sealed where the quantity of air discharged from one air exhaust port 1*a* is expressed by $V_0$, the equation v can be expressed as follows:

$$v = \sqrt{\frac{2e}{Cd} \cdot \frac{W}{\gamma} \cdot \frac{Ad - Ac}{Ac^{\frac{3}{2}}} + \frac{V_0}{Ac}}$$

From this equation, it can be noted that the falling speed of the capsule 5 can be increased by $V_0/Ac$ by exhausting air from the exhaust port 1*a*.

Consequently, the falling speed of the dust capsule can be made constant by increasing the air exhausting quantity $V_0$ from the exhaust port 1*a* when the weight of the capsule 5 is small and hence the falling speed is lower than a predetermined speed, whereas by decreasing the exhaust quantity $V_0$ where the weight of the capsule is large and hence the falling speed is high.

Figure 4A:
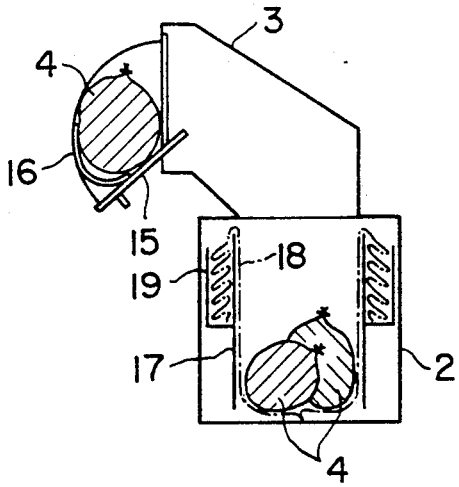
FIGS. 4*a* and 4*b* are partial views showing a capsule inlet port.
Figure 4B:
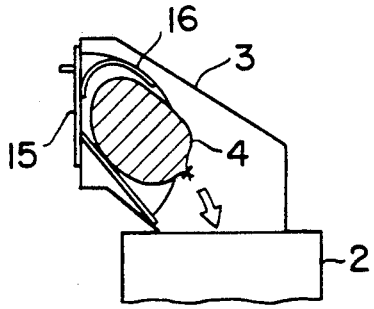
Figure 5:
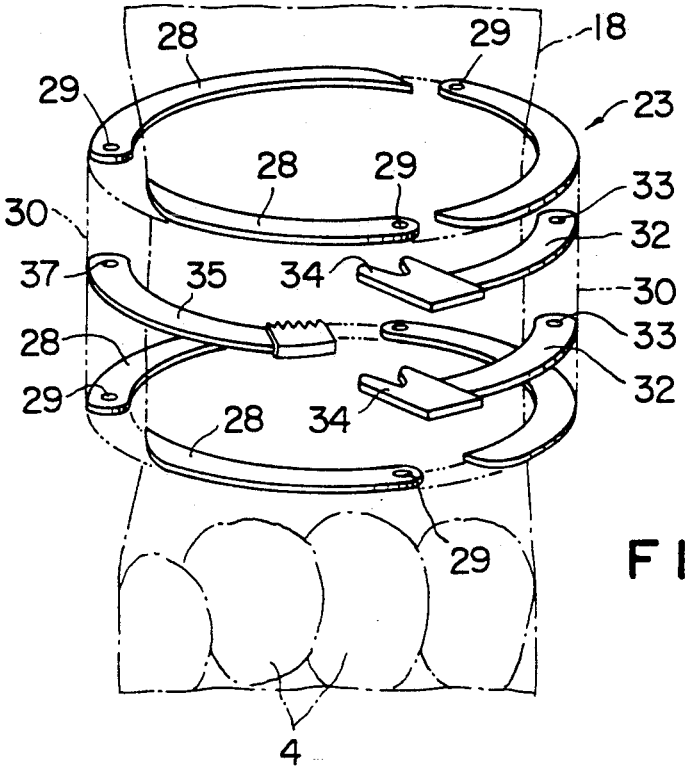
Figure 6:
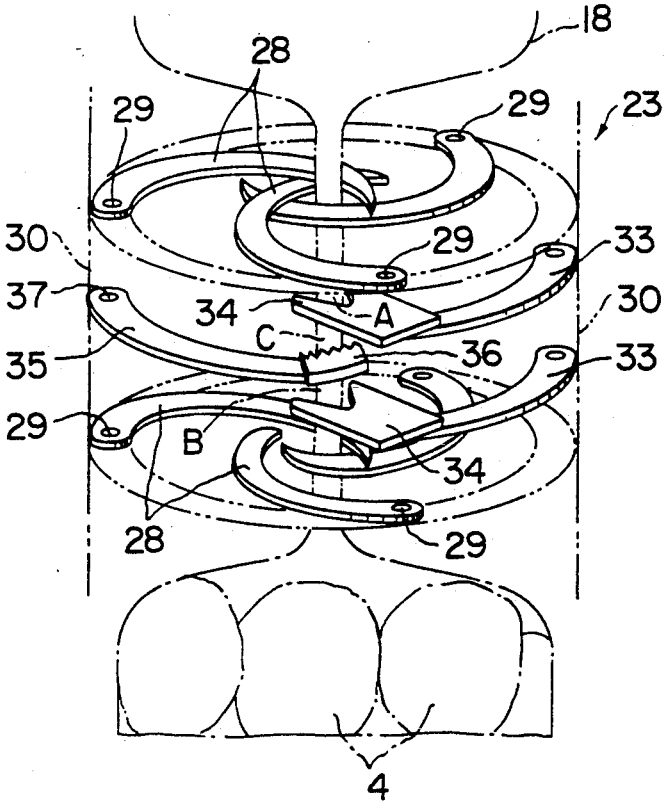
Figure 7:
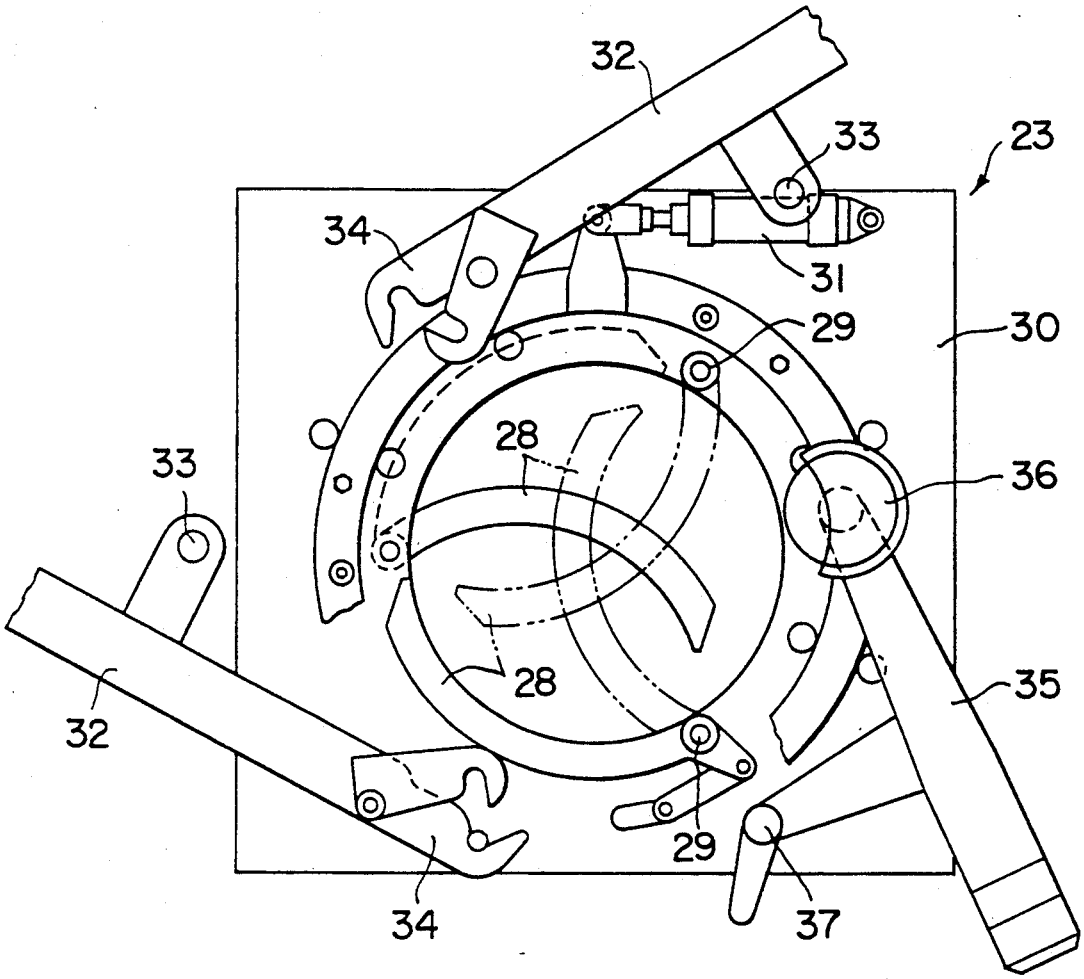
Figure 8:
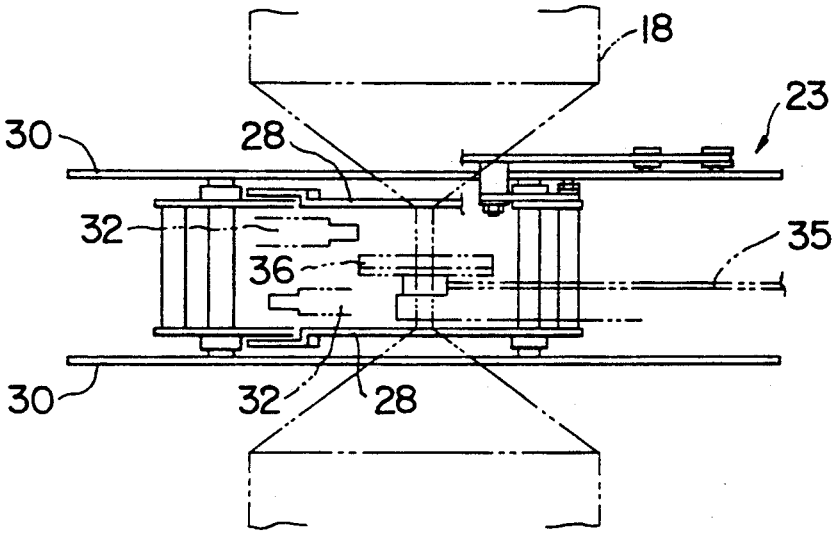

As shown in FIGS. 4*a* and 4*b*, the capsule inlet port 3 is constructed to be closed by a lid 15 which is provided with an arcuate guide plate 16 which can limit the volume of the thrown in dust to be smaller than a predetermined volume.

Although not shown in the drawings, a counter for counting the number of capsules thrown into the inlet port 3 may be provided near the inlet port.

As shown in FIG. 1, beneath the inlet port 3, is contained a cylindrical dust receiver 17 in the body 2. A cassette 19 containing a corrugated cylindrical synthetic resin film (hereinafter called a polysheet) 18 is removably mounted about the dust receiver, and a slidable plate 20 is arranged beneath the dust receiver. For mounting the cassette 19 about the dust receiver, a predetermined length of the polysheet 18 is pulled out of the cassette. After clipping the lower end 18*a* of the polysheet 18 the polysheet is disposed in the dust receiver 17. A piston-cylinder assembly, not shown, is provided in the dust receiver 17 for causing the polysheet 18 to slide on the slidable plate 20.

Above the dust receiver 17 is disposed a vertically movable piston-cylinder assembly 21 for compressing and moving the polysheet filled with dust. An auxiliary cylinder 22 is disposed beneath the piston-cylinder assembly 22, and an automatic clipping device 23 is arranged slightly above the auxiliary cylinder 22.

By counting the numbers of throwing in of the dust, the fact that the polysheet bag 18 in the dust receiver 17 has been filled with the dust can be detected. Then the dust receiver moving piston-cylinder assembly (not shown) is operated to move the dust receiver 17 and polysheet 18 to a position below the piston-cylinder assembly 21. Then this assembly is operated to move the polysheet 18 filled with dust into the auxiliary cylinder 22 through the automatic clipping device 23 thereby compressing the dust.

The automatic clipping device 23 is provided for the purpose of clipping and cutting the polysheet 18 at a predetermined position. By this operation the polysheet 18 is cut to form a sealed capsule 5. At the time of mounting cassette 19, the lower end of the polysheet 18 is manually clipped or bound. Thereafter, cutting and clipping of the polysheet are automatically performed by the automatic clipping device 23.

The outer diameter of the polysheet 18 or the sealed capsule is made to be slightly smaller than the inner diameter of the vertical chute.

An intermediate cylinder 24 having the same configuration as the auxiliary cylinder 22 and forming a portion of the vertical chute 1 is connected to the auxiliary piston-cylinder assembly 26 through a connecting rod 25 and the intermediate cylinder 24 is connected to a piston-cylinder assembly 26 for laterally moving the auxiliary cylinder 22 and the intermediate cylinder 24.

At the time of throwing in the dust, the intermediate cylinder 24 constitutes a portion of the vertical chute. In other words, the upper chute portion and the lower chute portion are interconnected by the intermediate cylinder 24 when the piston-cylinder assembly 26 is actuated.

Flanges 24*a* are formed at both upper and lower ends of the intermediate cylinder 24. In the same manner, the vertical chute 1 is also provided with flanges. By bolting together these flanges, with rubber packings 27 interposed therebetween the vertical chute can be sealed.

The detail of the automatic clipping device 23 is shown in FIGS. 5 through 8.

As shown, the automatic clipping device 23 has a substantially cylindrical shape so that the polysheet 18 can pass therethrough. Crescent shaped squeezing members 28 are provided in two vertically spaced stages, each including three members. Each crescent shaped member 28 is rotatably connected to a circular frame 30 through a pin 29.

Normally, the crescent shaped members 28 are opened but when an air cylinder 31 (see FIG. 7) is operated, the crescent shaped members are squeezed, or rotated toward the axis of the automatic clipping device. The order of operation of the crescent shaped members 28 is such that members in the upper stage are firstly closed and then those in the lower stage are closed after a short interval.

Two sets of clipping arms 32 are provided between the upper and lower stages of the crescent shaped members 28, each clipping arms 32 being rotatably connected to the frame 30 through a pin 33.

At the inner end of each clipping arm 32 is connected a clipping member 34 for clipping the polysheet 18. The clipping arms 32 are rotated by an air cylinder, not shown. After squeezing the polysheet filled with dust at two points, the polysheet 18 is clipped at two vertically spaced points A and B. At point A, the lower end of a next capsule 5 is closed, whereas at point B the upper end of the capsule is clipped.

At about the center of the clipping arms 32 there is provided a cutter arm 35 having a cutter 36 at its inner end. With this cutter, the polysheet 18 is cut at a point C intermediate of points A and B so as to separate a capsule 5 with both ends closed from the polysheet 18. This cutter arm 35 too is swung about pin 37 by an air cylinder, not shown.

As above described a capsule 5 with both ends sealed and filled with dust is formed by using polysheet 18. By squeezing the polysheet 18 with upper squeezing members 28 and lower squeezing members 28, air can be entrapped in the completed capsule 5.

Figure 11A:
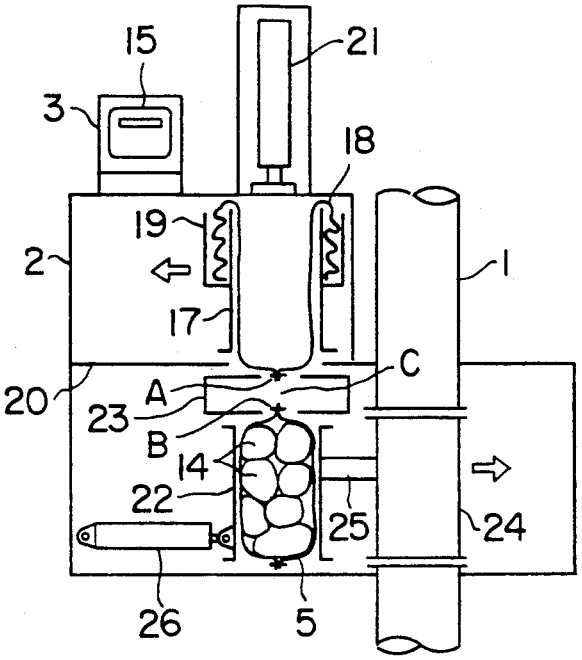
Figure 11B:
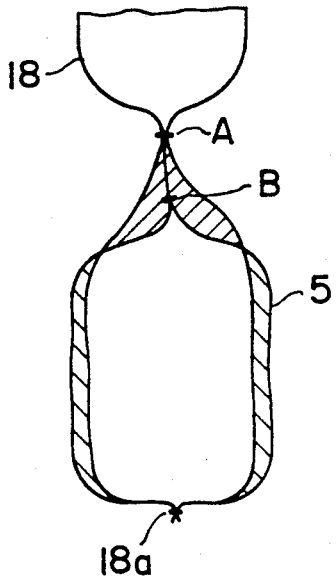

More particularly, as shown in FIG. 11*b*, the polysheet 18 is firstly squeezed with upper squeezing members 28, and a little time later the polysheet 18 is squeezed by a lower squeezing members 28. Then the air contained in the polysheet 18 in a section between both ends of a capsule is sealed therein whereby the size of the capsules 5 can be made uniform.

The size of the polysheet 18 is selected such that the gap area between the inner wall of the chute and the outer wall of the capsule is about 8–10% of the cross-sectional area of the dust chute.

The embodiment thus far described operates as follows.

Figure 9:
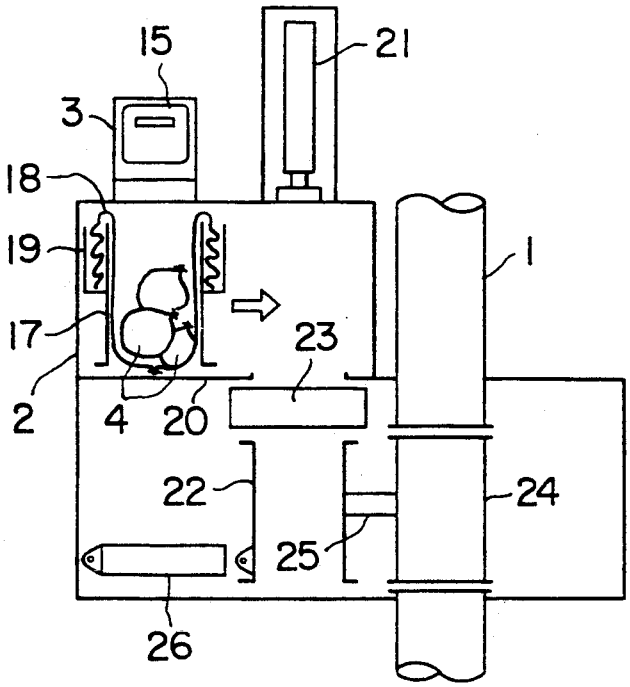
FIGS. 9 through 12 are front views, partially cut away, showing successive steps of conveyance.

The dust thrown in through port 3 is packed in the polysheet 18 contained in the dust receiver 17, as shown in FIG. 9. At this time the lower end 18*a* of polysheet 18 has been manually bound at the time of mounting the cassette 19. Thereafter, the end of the polysheet is automatically clipped in a manner as above described. The fact that the polysheet 18 has been filled with dust can be detected by counting the number of throwing in of the dust.

Figure 10:
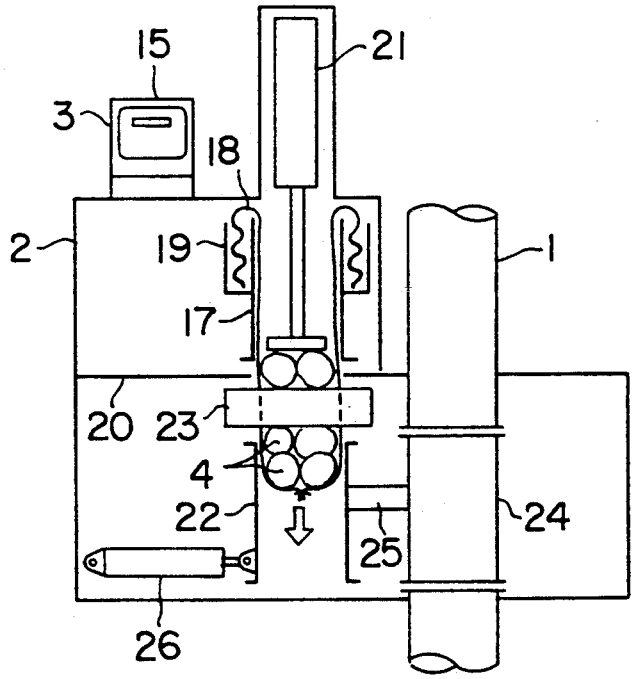

Then as shown in FIG. 10, the dust receiver moving piston-cylinder assembly is actuated to move the dust receiver 17 to a beneath position of the vertical piston-cylinder assembly 21. Then this piston-cylinder assembly 21 is actuated to pull out the polysheet 18 from cassette 19. At the same time the polysheet 18 filled with dust is passed through the automatic clipping device 23 to be positioned in the auxiliary cylinder 22.

Under these conditions, as shown in FIG. 11*a*, the automatic clipping device 23 is operated to squeeze the polysheet at two vertically spaced points using the squeezing members 28. Then the polysheet is cut at point C by cutter 36, thus cutting off from the polysheet 18 a capsule sealed at both ends and packed with dust.

Figure 12:
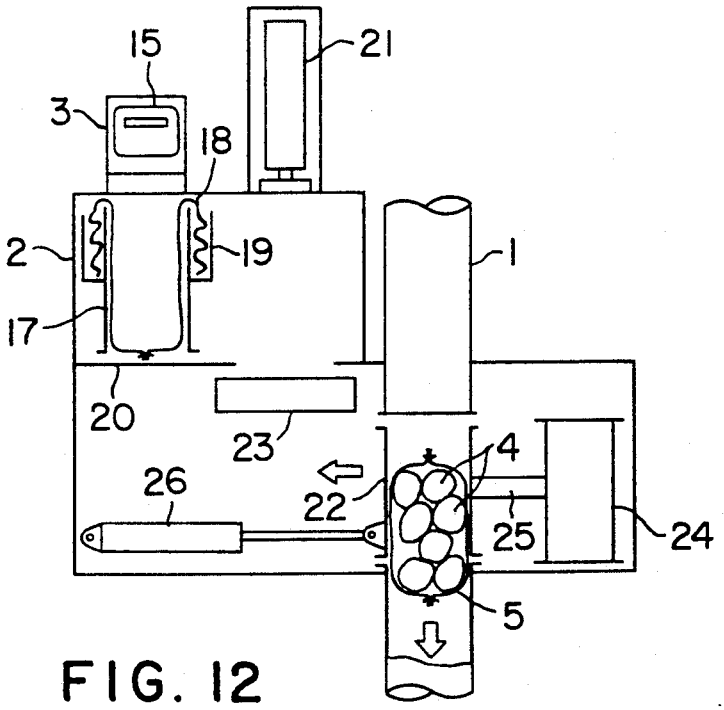

Then as shown in FIG. 12, the piston-cylinder assembly 26 is actuated to shift the auxiliary cylinder 22 to a portion of the vertical chute 1, thereby dropping the capsule 5 contained in the auxiliary cylinder 22 through the vertical chute 1. At this time, the quantity of air discharged from the port la is controlled such that the falling speed of the capsule would be constant. Further, the dust receiver moving piston-cylinder assembly is operated in the opposite direction for returning the dust receiver 17 to the original position below the dust throwing in port 3.

Then the cylinder moving piston-cylinder 26 is moved in the opposite direction for returning the auxiliary cylinder 22 to the original position immediately below the vertical piston cylinder assembly 21 and to move the intermediate cylinder 24 to a position forming a portion of the vertical chute.

Figure 13:
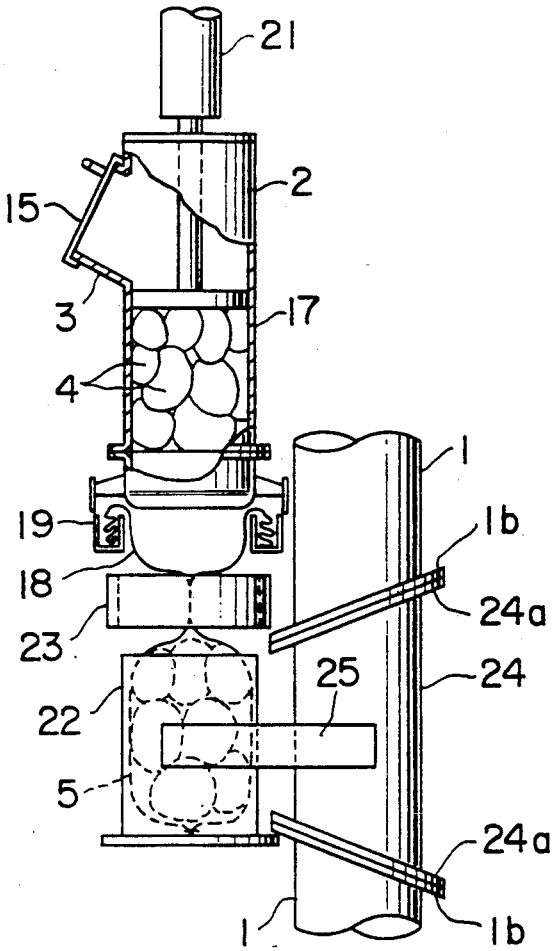
FIG. 13 is a front view showing essential parts of a modified embodiment of this invention.
Figure 14:
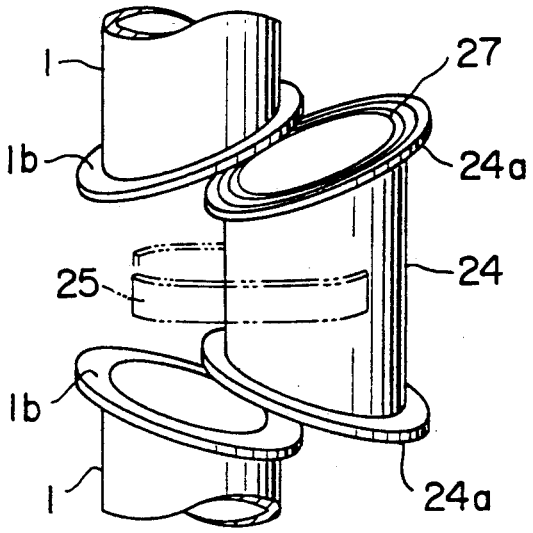
FIG. 14 is an enlarged view showing certain parts of the modified embodiment shown in FIG. 13.

FIGS. 13 and 14 show a modified embodiment of this invention which differs from the foregoing embodiment in the following points. More particularly, a vertical piston-cylinder assembly 21, a stationary dust receiver 17 communicated with port 3, the automatic clipping device 23 and the auxiliary cylinder 22 are linearly arranged in succession. With this construction, it is not necessary to move the dust receiver 17 and by the operation of the vertical piston-cylinder assembly 21 the polysheet 18 packed with dust is moved into the auxiliary cylinder 22 through the automatic clipping device 23. Further, the upper and lower surfaces of the intermediate cylinder 24 are inclined toward the axis of the vertical chute.

With this intermediate cylinder having inclined upper and lower surfaces 24*a* it can be snugly fit between divided sections of the chute, thus improving air tightness, and preventing bad odor and noise.

According to this invention, since the capsule is made of a flexible polysheet or the like so that the capsule can be formed into a cylindrical body and entrap therein air, the area of the space between the capsule and the chute can be made small and constant. This narrow gap increases the air resistance to the falling capsule. Thus the deceleration effect to the capsule can be greatly increased than the prior art frustoconical shaped capsule. Accordingly, it is not necessary to strictly limit the gap area or to decelerate the falling capsule by upwardly flowing air. Thus it becomes possible to decelerate as desired the falling capsule without increasing the installation cost.

Moreover recovery of a large capsule can be made readily and the housewife can readily discard dust by merely packing the dust in a vinyl bag usually used in shopping. Further it is not necessary to use a special small bag which requires transfer of the dust into a bag of standard size.

Figure 15:
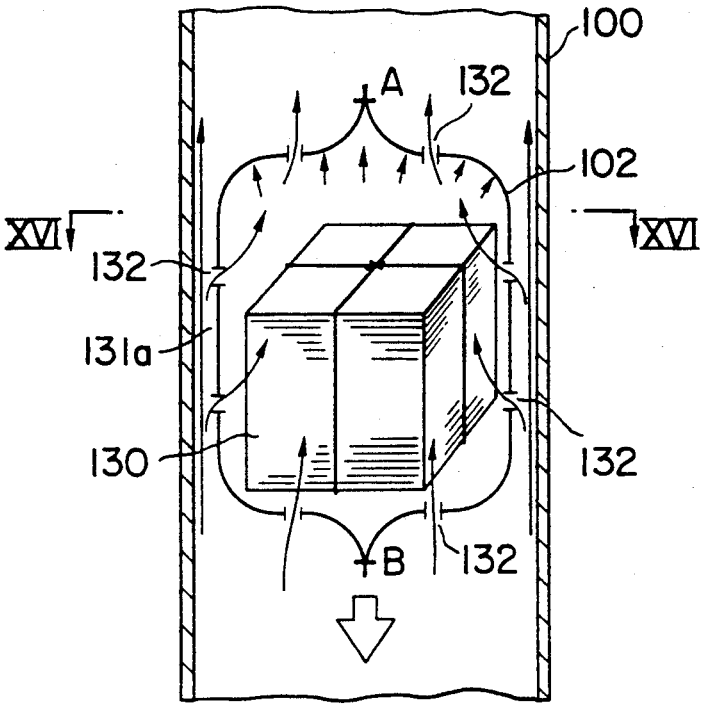
FIG. 15 is an enlarged vertical sectional view showing a cylindrical chute, and a capsule enclosed in a perforated polysheet bag.
Figure 16:
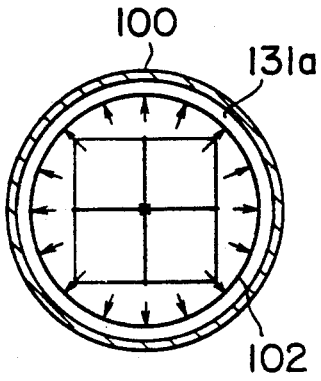
FIG. 16 is a cross-sectional view taken along a line XVI—XVI.
Figure 17:
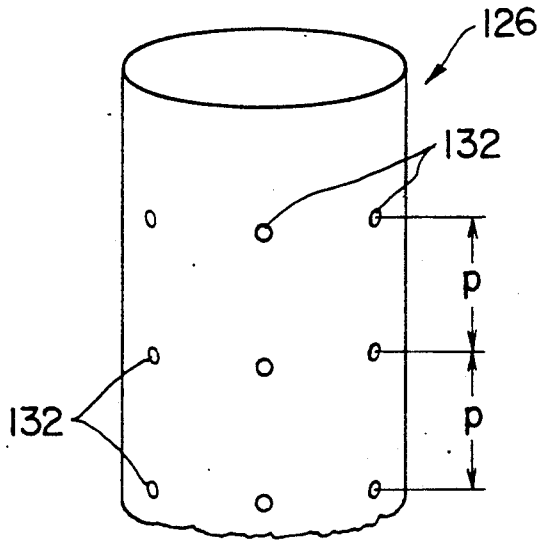
FIG. 17 is a perspective view showing a portion of a cylindrical polysheet.

Still another embodiment of this invention is shown in FIGS. 15 through 17. FIGS. 15 and 16 show a state of falling down of a capsule 102 containing dust 130 in the form of a not cylindrical large block, for example a stack of news papers or magazines through a vertical chute 101. As shown, a capsule bag 102 containing a not cylindrical dust 130 is provided with suitable spaced air openings 132.

With this construction when the capsule bag 102 falls down through the dust chute 101 air flows into the bag through openings 132 at the bottom and side surfaces of the bag and leaves the bag through air openings 132 formed through the upper portion of the bag. However, the number of air opening at the side and bottom of the dust bag 102 is larger than the number of air openings through the upper surface so that the dust bag 102 expands outwardly to form a cylindrical bag.

Thus, the capsule 102 has an outer contour a little smaller than the inner wall of a dust chute 101 having a circular cross-section, the gap between them is small. Accordingly, the air resistance to the falling capsule increases which decreases the falling speed of the capsule.

When the air pressure in the chute below the capsule is measured, the weight of the capsule can be estimated so that the air pressure in the chute can be adjusted to a suitable value by increasing or decreasing the quantity of air discharged to the outside from the bottom of the chute.

More particularly, where the capsule is not heavy and the air pressure in the chute is not too high, the quantity of air discharged from the bottom of the chute is increased to decreases the air pressure in the chute, thereby increasing the falling speed of the capsule. In this manner the falling speed of the capsule can be adjusted to a value suitable to cause the capsule to drop on the bottom of the chute without shock.

As shown in FIG. 16 the capsule is made of a polysheet 126 (a soft cylindrical member made of a synthetic resin. Through the peripheral wall of polysheet 126 are provided a plurality of perforations 132 at a predetermined pitch p. The pitch p is selected to be shorter than the radius of cylindrical polysheet so that when the polysheet is clipped to form a capsule as has been described before, the polysheet enclosing each capsule has a plurality of perforations.

It should be understood that the arrangement of perforations 132 is not limited to that shown in FIG. 17. For example, the perforations can be formed helically, cross-helically, straightly in a single or plurality of columns in parallel with the axis of the cylindrical polysheet.

What is claimed is:

1. A conveyor system of a dust container used in a building comprising:

a vertical chute having a cylindrical section for falling down a dust container packed with dust discarded from respective floors of said building;

said container being formed of soft cylindrical body having a smaller outer diameter than an inner diameter of said vertical chute;

means for laterally moving a portion of said chute to convey said container into said vertical chute;

first means for clipping upper and lower ends of said soft cylindrical body to form said container packed with dust;

a bottom plate located near a lower end of said vertical chute;

second means for laterally moving said bottom plate for closing the lower end of said chute;

adjustable air discharging means located above said bottom plate for discharging air from the vertical chute to outside; and a pressure detector for detecting air pressure in said vertical chute and for adjusting said air discharge means so as to control falling speed of said dust container.

2. The conveyor system according to claim 1, wherein said soft cylindrical body is made of a film of a pliable synthetic resin.

3. The conveyor system according to claim 2, wherein said film is formed with a plurality perforations.

4. The conveyor system according to claim 1, wherein said dust comprises a stack of news papers or magazines.

5. The conveyor system according to claim 1, further comprising: a cylindrical dust receiver laterally spaced from said vertical chute and located at a dust inlet port of each floor; a cassette surrounding said dust receiver and containing a corrugated polysheet supplied into said dust container; means for laterally moving said dust receiver to a position near said vertical chute; first means for compacting said dust contained in said dust receiver; means for clipping both ends of polysheet for forming a capsule; second means for transferring said capsule into an auxiliary cylinder; and third means for laterally moving said auxiliary cylinder into a gap of said vertical chute thereby permitting said capsule to fall down in said vertical chute.

6. The conveyor system according to claim 5, wherein said clipping means comprises upper and lower stages of crescent shaped squeezing members, an outer end of each squeezing members being swingably supported by a frame, means for sequentially closing said squeezing members of the upper and lower stages by rotating said frame for sequentially clipping both ends of a section of said polysheet, and cutting means located between said upper and lower stages for cutting said polysheet between said clipped ends.

7. The conveyor system according to claim 3, wherein said plurality perforations provided at a predetermined pitch being shorter than a radius of said soft cylindrical body.

8. A conveyor system of dust containers used in a tall building comprising:

a vertical dust chute for falling down a dust containers packed with dust discarded from respective floors of said building;

said dust chute having a removable section, upper and lower ends of said removable section and end portions of said dust chute, said removable section between the removable section and the end portion is inserted to form a continuous chute are inclined;

a stationary dust receiver containing a cylindrical polysheet filled with dust;

means for compacting said dust;

clipping means for clipping opposite ends of said polysheet containing compacted dust and for forming a capsule of dust;

an auxiliary cylinder located below said clipping means for receiving said capsule of dust from said clipping means;

first means for mechanically interconnecting said auxiliary cylinder and said removable portion; and second means for simultaneously shifting said auxiliary cylinder and said removable section for aligning said auxiliary cylinder with said dust chute and for separating away said removable section from said dust chute.

* * * * *